US009579890B2

(12) United States Patent
Marchant et al.

(10) Patent No.: US 9,579,890 B2
(45) Date of Patent: Feb. 28, 2017

(54) PRINTHEAD DRIVE CIRCUIT WITH VARIABLE RESISTANCE

(71) Applicant: Xaar Technology Limited, Cambridge (GB)

(72) Inventors: James Edward David Marchant, Buckingham (GB); Stephen Mark Jeapes, Cambridge (GB); Ian Anthony Hurst, Wilburton (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 14/850,153

(22) Filed: Sep. 10, 2015

(65) Prior Publication Data

US 2016/0067960 A1 Mar. 10, 2016

(30) Foreign Application Priority Data

Sep. 10, 2014 (GB) ..... 1415988.3

(51) Int. Cl.
*B41J 2/045* (2006.01)

(52) U.S. Cl.
CPC ..... *B41J 2/04586* (2013.01); *B41J 2/0459* (2013.01); *B41J 2/04541* (2013.01); *B41J 2/04581* (2013.01); *B41J 2/04588* (2013.01); *B41J 2202/12* (2013.01)

(58) Field of Classification Search
CPC B41J 2/04501; B41J 2/04541; B41J 2/04575; B41J 2/04586; B41J 2/04581; B41J 2/0459; B41J 2/04588; B41J 2202/12
See application file for complete search history.

(56) References Cited

U.S. PATENT DOCUMENTS

| | | | |
|---|---|---|---|
| 5,453,767 | A | 9/1995 | Chang et al. |
| 6,276,772 | B1 | 8/2001 | Sakata et al. |
| 9,399,342 | B2 | 7/2016 | Marchant |
| 2003/0234826 | A1 | 12/2003 | Hosono et al. |

(Continued)

FOREIGN PATENT DOCUMENTS

| | | |
|---|---|---|
| JP | 2004-17534 | 1/2004 |
| WO | WO 2010/055345 A1 | 5/2010 |

OTHER PUBLICATIONS

Search Report dated Mar. 11, 2015 for GB Application No. 1415988.3, 6 pages.

(Continued)

*Primary Examiner* — Manish S Shah
*Assistant Examiner* — Yaovi M Ameh
(74) *Attorney, Agent, or Firm* — Patterson Thuente Pedersen, P.A.

(57) ABSTRACT

A printhead for a printer has actuating elements for ejecting fluid, and a drive circuit for selectively applying a drive waveform having several slopes, to an actuating element, according to a print signal. A resulting printhead has a lesser sensitivity to changes of slew rate in one slope of the drive waveform than a sensitivity to change in another. The drive circuit has a variable resistance circuit, and a control circuit to control the variable resistance circuit to adjust a slew rate of the slope of lesser sensitivity according to a trim signal. By making the adjustment less sensitive, the trim signal and trim control can have more relaxed tolerances, thus can employ simpler, cheaper circuitry.

13 Claims, 10 Drawing Sheets

(56) References Cited

U.S. PATENT DOCUMENTS

| | | | | |
|---|---|---|---|---|
| 2005/0041073 | A1 | 2/2005 | Fontaine et al. | |
| 2005/0200639 | A1 | 9/2005 | Kobayashi et al. | |
| 2006/0092201 | A1* | 5/2006 | Gardner | B41J 2/04508 347/10 |
| 2009/0212831 | A1 | 8/2009 | Kondoh | |
| 2010/0097114 | A1 | 4/2010 | Miyazaki et al. | |
| 2010/0171778 | A1 | 7/2010 | Ozawa | |
| 2010/0328380 | A1 | 12/2010 | Oshima | |
| 2011/0273498 | A1 | 11/2011 | Kasai et al. | |
| 2012/0249638 | A1 | 10/2012 | Takano et al. | |
| 2012/0262512 | A1 | 10/2012 | Oshima et al. | |
| 2013/0321507 | A1 | 12/2013 | Mardilovich et al. | |
| 2014/0210884 | A1 | 7/2014 | Rosario et al. | |
| 2016/0067963 | A1 | 3/2016 | van Brocklin et al. | |

OTHER PUBLICATIONS

Application and File history for U.S. Appl. No. 14/850,204, filed Sep. 10, 2015. Inventors: van Brocklin et al.

Application and File history for U.S. Appl. No. 14/850,303, filed Sep. 10, 2015. Inventors: Marchant et al.

Search Report dated Mar. 11, 2015 for GB Application No. 1415986.7, 5 pages.

Search Report dated Mar. 9, 2015 for GB Application No. 1415987.5, 5 pages.

Office Action dated Dec. 20, 2016 for Japanese Application No. 2015-178198, 9 pages.

* cited by examiner

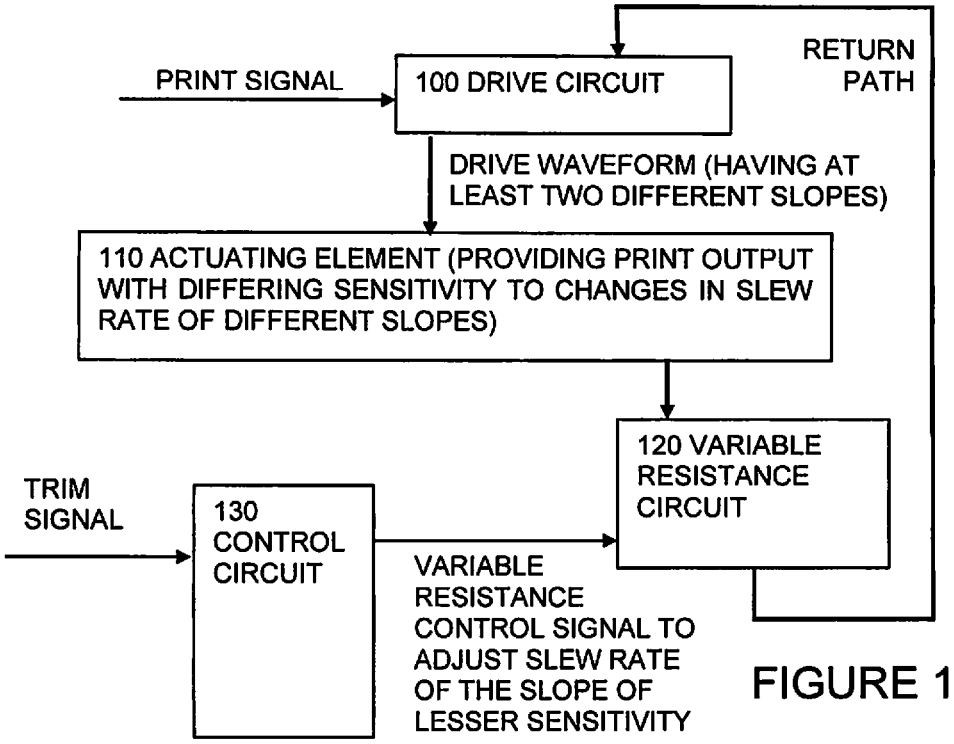
FIGURE 1
FIGURE 2
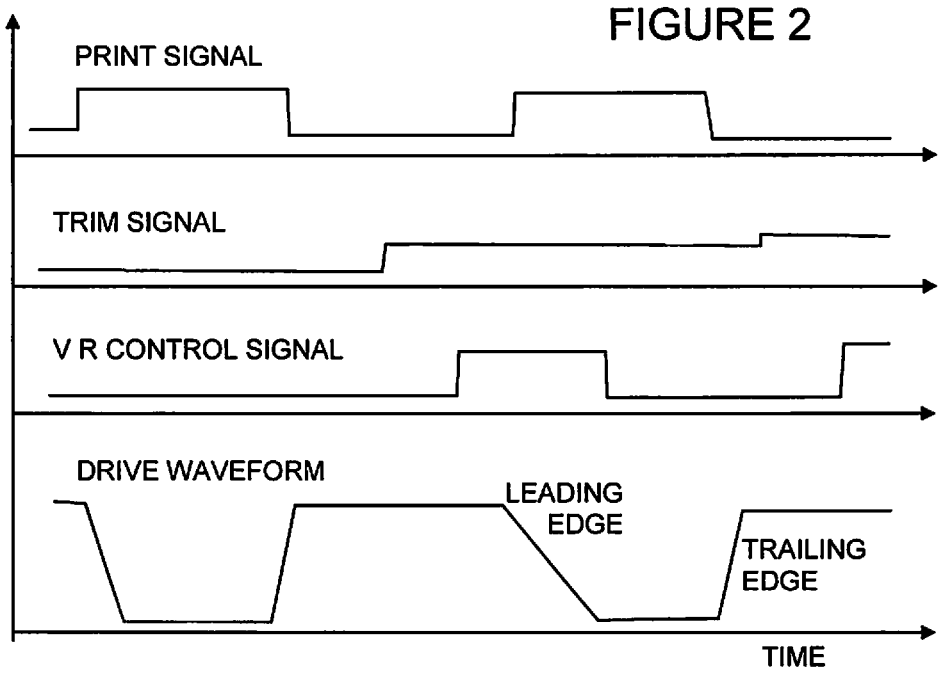

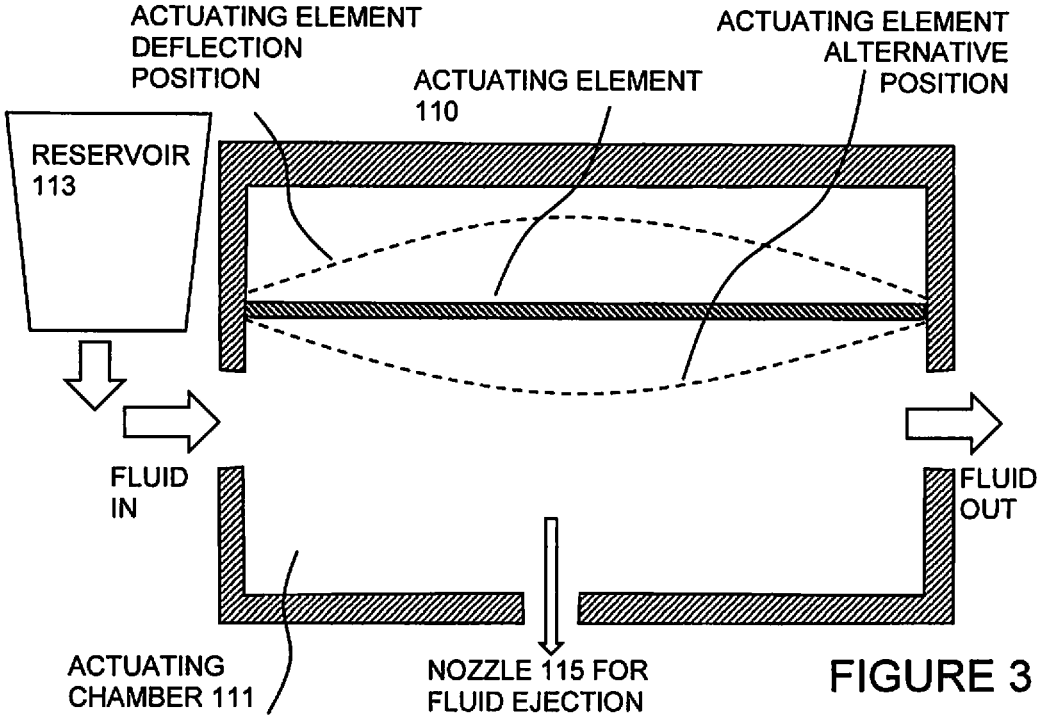
FIGURE 3
FIGURE 4
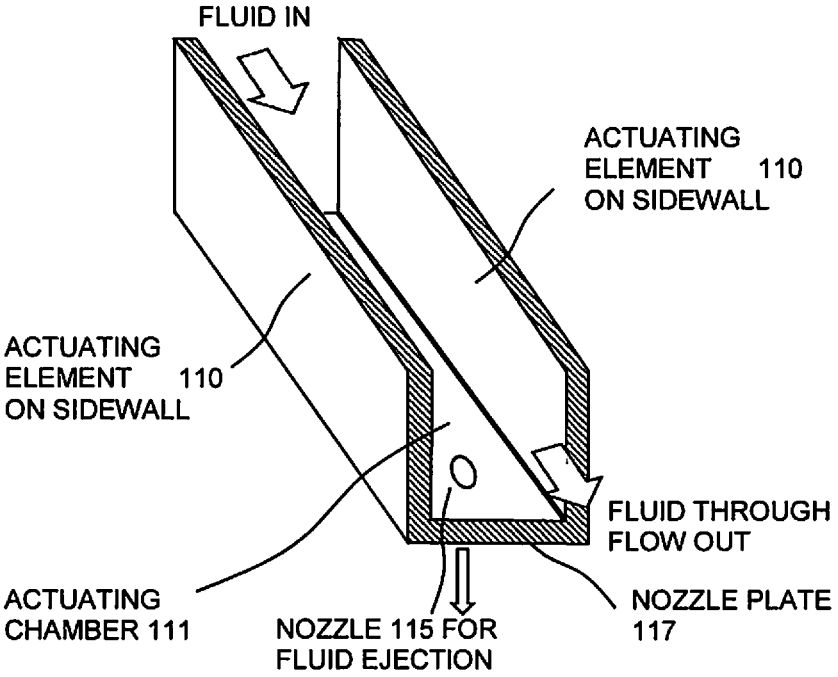

PRINTHEAD DRIVE CIRCUIT WITH VARIABLE RESISTANCE

RELATED APPLICATION

The present application claims priority to GB Application No. 1415988.3 filed Sep. 10, 2014, which is hereby incorporated herein in its entirety by reference.

TECHNICAL FIELD

The present invention relates to printheads having actuating elements for printing and drive circuits for driving the actuating elements, to printers having such printheads, to corresponding drive circuits and to methods of operating such drive circuits.

BACKGROUND

Existing printhead circuits such as hot switch or cold switch driver ASICs for driving actuating elements have limitations in terms of their cost and power dissipation. So there is a question of how to provide electrical drive signals for an actuating element such as those having a piezoelectric actuator at the lowest circuit area (to reduce the cost) and with the lowest power dissipation while still meeting minimum drive requirements. Multiple drive methods for printhead actuating elements have been proposed and there are multiple different types in use today. Some are briefly discussed now.

Hot Switch: This is the class of driving methods that keep the demux function and the power dissipation (CV^2) in the same driver IC. This was the original drive method, before cold switch became popular.

Rectangular Hot Switch: This describes hot switch systems that have no flexible control over rise and fall time and only two voltages (0V and 30V for example). In some cases waveform delivery is uniform to all the actuating elements. The waveform has some level of programmability.

DAC Hot Switch describes a class of drive options that has a logic driving an arbitrary digital value stream to a DAC per nozzle, and outputs a high voltage drive power waveform scaled from this digital stream. In terms of driving flexibility, this option has the most capability. It is limited only by the number of digital gates and the complexity that system designers can use and/or tolerate.

Cold Switch Demux: This describes an arrangement in which all actuating elements are fed the same drive signal through a pass gate type demultiplexer. The drive signal can be gated at sub-pixel speeds.

It is also known to provide some factory calibration of differences between individual actuating elements and to provide compensation by "trimming" the drive signal applied to the different actuating elements. Such "trimming" may be effected by adjusting one or more of the drive waveform characteristics, for example voltage and/or slew rate. Patent application US20130321507 shows compensating for actuating element variations and changes by altering rise times of drive pulses for individual actuating elements which governs a rate of ejection of a droplet, and thus alters the appearance of a printed dot. The ejection rate is altered by changing an amount of series resistance or an internal resistance of a drive circuit according to a current sensing signal which indicates changes in actuating element capacitance from temperature or ageing effects.

SUMMARY

Embodiments of the invention can provide improved apparatus or methods or computer programs. According to a first aspect of the invention, there is provided a printhead having actuating elements (110) for ejecting fluid, a drive circuit (100) for receiving a common drive waveform, the drive circuit comprising a drive switch for selectively switching the common drive waveform onto the actuating element, the drive circuit configured to selectively apply a drive waveform to at least one of the actuating elements according to a print signal to cause the fluid to be ejected, with resulting droplet ejection properties being dependent with respective sensitivities on at least two different slew rates in the drive waveform, the sensitivity being lower to altering one of the slew rates compared to altering any other of the slew rates, the drive circuit further having a variable resistance circuit (120), and a control circuit (130) configured to control the variable resistance circuit according to a trim signal to adjust the first of the slew rates, preferentially over any adjustment to any other of the slew rates.

We also describe a printhead having: actuating elements for ejecting fluid, and a drive circuit for selectively applying a drive waveform to at least one of the actuating elements according to a print signal to cause the fluid to be ejected, with resulting droplet ejection properties being dependent with respective sensitivities on at least two different slew rates in the drive waveform, the sensitivity being lower to altering one of the slew rates compared to altering any other of the slew rates, and the drive circuit having a variable resistance circuit, and a control circuit configured to control the variable resistance circuit according to a trim signal to adjust the first of the slew rates, preferentially over any adjustment to any other of the slew rates. An advantage is that finer adjustment can be made, or the trim signal and trim control can have more relaxed tolerances. Thus simpler, cheaper circuitry can be used for a given precision of trimming control and thus for a given image quality when compensating for undesirable effects such as those caused by image dependent firing frequency, or print history, cross talk, temperature, ageing, differences between actuating elements and so on.

Any additional features can be added to any of the aspects, or disclaimed, and some such additional features are described and some set out in dependent claims. One such additional feature is the variable resistance circuit comprising a drain source path of a transistor and the control circuit comprising a gate bias control circuit coupled to a gate of the transistor to control a drain source resistance of the transistor according to the trim signal. This is an efficient way of implementing the variable resistance. See FIG. 5 for example.

Another such additional feature is the variable resistance circuit having a plurality or "bank" of resistors and corresponding resistor switches for selectively coupling the resistors into use. This can provide a wider range of resistance, and can be less susceptible to manufacturing variations for example. This can be combined with the transistor based variable resistance to benefit from the advantages of both types. See FIG. 7 for example.

Another such additional feature is the drive circuit having a drive switch for selectively switching a common drive waveform onto the actuating element, and the variable resistance circuit being coupled in series with the drive switch and the actuating element. This cold switch type of drive circuit enables lower dissipation at the printhead. See FIG. 5 or 6 for example.

Another such additional feature is the transistor of the variable resistance circuit being configured as the drive switch for the drive circuit. This enables the trim to be implemented with fewer components. See FIG. 6 for example.

Another such additional feature is an actuating chamber associated with the actuating element, the actuating chamber having a fluid ingress path for coupling with a reservoir for supply of the fluid and having a nozzle for the ejection of the fluid from the actuating chamber, such that the ejection can be stimulated by displacement of the actuating element causing pressure change in the fluid in the actuating chamber. See FIG. 3 for example.

Another such additional feature is the actuating chamber and a timing of the slew rates of the drive waveform being configured to promote an acoustic wave in the fluid in the actuating chamber to cause the ejection. See FIG. 4 for example.

Another such additional feature is a further trim circuit configured to adjust an amplitude of the drive waveform according to a further trim signal. This can help provide adjustment of more factors such as droplet speed and droplet weight, and can provide a greater range of adjustment. See FIGS. 10 and 11 for example.

Another aspect of the invention provides a printer having a printhead as set out above. See FIG. 12 for example.

Another aspect of the invention provides a drive circuit suitable for the printhead, and having features as set out above. This can be in the form of an integrated circuit.

Another aspect of the invention provides a method of operating a printer having actuating elements for ejecting fluid, the method having steps of: receiving a common drive waveform, switching the common drive waveform onto the actuating elements, selectively applying a drive waveform to one of the actuating elements according to a print signal to cause the fluid to be ejected, with a resulting print being dependent on at least two different slew rates in the drive waveform, the dependency having a lesser sensitivity to changes in slew rate of one of the slew rates compared to changes in slew rate of another part of the drive waveform, generating a trim signal for adjusting the drive waveform to compensate for unwanted distortions, by adjusting a slew rate of lesser sensitivity, preferentially over any adjustment of the other slew rate.

A further aspect of the invention provides a printhead having: actuating elements (110) for ejecting fluid, a drive circuit (100) for selectively applying a drive waveform to at least one of the actuating elements according to a print signal to cause the fluid to be ejected, with resulting droplet ejection properties being dependent on at least a droplet-ejecting edge of the drive waveform and a non-droplet-ejecting edge of the drive waveform, wherein the non-droplet-ejecting edge enables fine control of the droplet ejection properties, such that the drive circuit having: a variable resistance circuit (120), and a drive switch for selectively switching the common drive waveform onto the actuating element, and a control circuit (130) configured to control the variable resistance circuit according to a trim signal to adjust the non-droplet-ejecting edge preferentially over adjustment to the droplet-ejecting edge.

The non-droplet-ejecting edge is also referred to herein as the leading (falling) edge and causes expansion of the actuating chamber to fill with fluid. The droplet-ejecting edge is also referred to herein as the trailing (rising) edge which causes ejection of the droplet. Advantageously, adjustment on the non-droplet-ejecting (falling) edge may enable finer control (since the actuator is less sensitive to changes in the non-droplet-ejecting edge), which may result in lower costs of circuitry for control of this trimming technique for example.

Numerous other variations and modifications can be made without departing from the claims of the present invention. Therefore, it should be clearly understood that the form of the present invention is illustrative only and is not intended to limit the scope of the present invention.

BRIEF DESCRIPTION OF THE DRAWINGS

How the present invention may be put into effect will now be described by way of example with reference to the appended drawings, in which:

FIG. 1 shows a schematic view of parts of a printhead according to an embodiment, FIG. 2 shows a schematic view of waveforms, FIG. 3 shows a schematic cross section view of an example of an actuating chamber including an actuating element, and a nozzle, FIG. 4 shows a schematic three quarter view of a through-flow actuating chamber.

DETAILED DESCRIPTION

Figure 5:
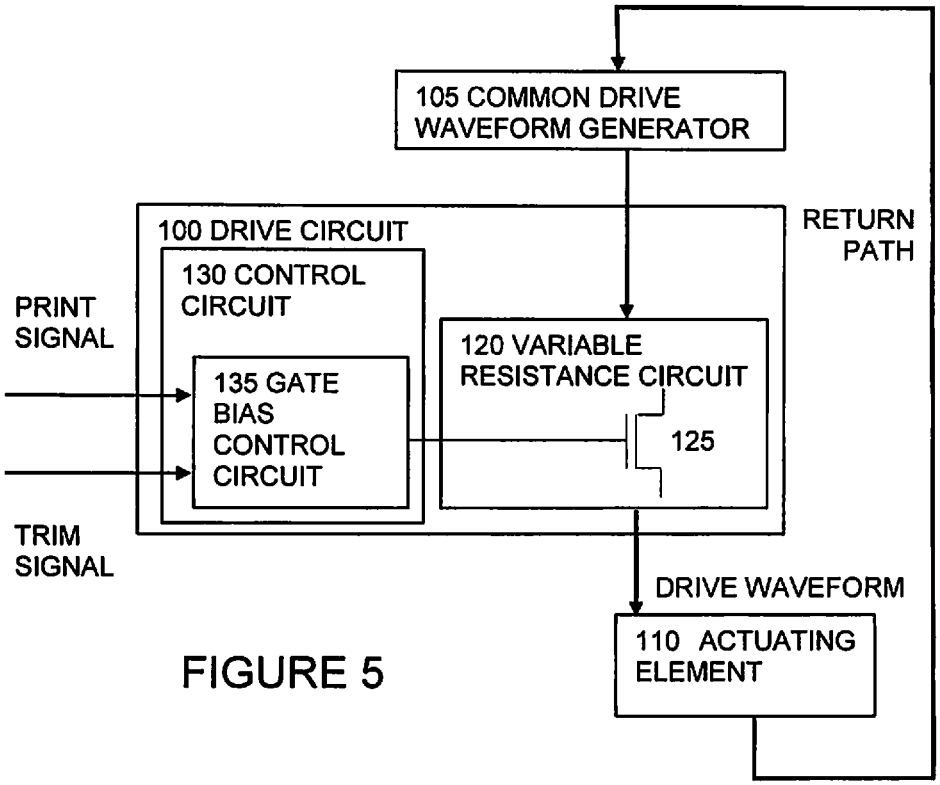
FIG. 5 shows a schematic view of an embodiment using drain source resistance of a transistor.

The present invention will be described with respect to particular embodiments and with reference to drawings but note that the invention is not limited to features described, but only by the claims. The drawings described are only schematic and are non-limiting. In the drawings, the size of some of the elements may be exaggerated and not drawn to scale for illustrative purposes.

Definitions:

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

References to programs or software can encompass any type of programs in any language executable directly or indirectly on any computer.

References to processor or computer are intended to encompass any kind of processing hardware which can be implemented in any kind of logic or analog circuitry, integrated to any degree, and not limited to general purpose processors, digital signal processors, ASICs (Application Specific Integrated Circuit), FPGAs (Field Programmable Gate Arrays), discrete components or logic and so on, and are intended to encompass implementations using multiple processors which may be integrated together, or co-located or distributed at different locations for example.

References to actuating chambers are intended to encompass any kind of actuating chamber comprising one or more actuating elements for effecting the ejection of droplets from at least one nozzle that is associated with the actuating chamber. The actuating chamber may eject any kind of fluid from at least one fluid reservoir for printing 2D images or 3D objects for example, onto any kind of media, the actuating chambers having actuating elements for causing droplet ejection from a nozzle in response to an applied electrical voltage or current, and the actuating chambers representing any type of suitable configuration of the geometry between its actuating element(s) and nozzle(s) to eject droplets, such as for example but not limited to roof mode or shared wall geometry.

References to actuating elements are intended to encompass any kind of actuating element to cause the ejection of droplets from the actuating chamber, including but not limited to piezoelectric actuating elements typically having a predominantly capacitive circuit characteristic or electrothermal actuating elements typically having a predominantly resistive circuit characteristic. Furthermore, the arrangement and/or dimensions of the actuating element are not limited to any particular geometry or design, and in the case of a piezoelectric element may take the form of, for example, thin film, thick film, shared wall, or the like.

References to arrays, groups or sets of the actuating elements are intended to encompass linear arrays of neighbouring actuating elements, or 2-dimensional rectangles or other patterns of neighbouring actuating elements, or any pattern or arrangement, regular or irregular or random, of neighbouring or non-neighbouring actuating elements.

Introduction to Features of Embodiments

Variability in actuating element performance can cause degradation in image quality during printing. Sources of the variability can be due to manufacturing variability, or due to the operating environment, for example the drop velocity may change with frequency over certain frequency ranges at which the actuator is operated. It is desirable to be able to control individual actuating elements to allow the control systems of the printer to compensate for these effects.

Effects to be compensated for can include for example:

- Firing frequency (same actuating element)
- Historic firing effects (same actuating element)
- Crosstalk from actuating elements in close proximity (due to electrical, fluidic and mechanical interference)
- Ambient and Ink temperatures
- Aging of PZT (lead zirconium titanate) material/MEMS structures The actuating element is provided with a drive waveform. There are several factors which affect the PZT response and hence the drop weight/velocity, one of which is the slew-rate of the rising and falling edges of the drive waveform.

To address such degradation, embodiments as described below use a series resistance to the actuating element to create an R-C circuit to adjust the slew rate of the drive waveform supplied to the actuating element. The actuating element is attached to or forms part of a wall or roof of an actuating chamber so that deformation of the actuating element alters the volume of the chamber, to increase or decrease the volume and therefore affect the pressure. Various configurations are possible, including having one, two or more actuating elements on a wall or ceiling or on opposing surfaces, and including configurations in which the pressure changes are timed and tuned to cause acoustic waves to be set up to produce particular pressure changes at different locations in the chamber as desired. An example waveform well known in the art in the case of a shared wall actuator, is described in EP0973644. An actuating chamber is placed initially in an expanded condition (a "draw"), subsequently switches to a contracted condition (a "reinforce") and then "releases" the actuating chamber back to its original, non-actuated, rest condition in order to eject a droplet. Since the actuating element (e.g. PZT) deforms in response to the voltage applied, changing the slew rate can enable trimming/calibration to improve image quality. The operation of the adjustment of slew rate can be carried out on any part of the drive waveform which causes a change in the drop ejection properties, for example on either the leading or trailing edge of a pulse or pulses. For some arrangements of actuating elements and actuating chamber and nozzle, an interesting result has been found. This is that the droplet ejection properties can have significantly different sensitivity to adjustment of the slew rates of different parts in the drive waveform. For the particular case of the leading and trailing edges of a pulse, where the leading (falling) edge causes expansion of the actuating chamber to fill with fluid, droplet ejection properties are found to be significantly less sensitive to adjustment of the falling edge than to an adjustment on the trailing edge which causes ejection of the droplet. This means that adjustment on the falling edge only, would mean finer control (since the actuator is less sensitive). This can result in lower costs of circuitry for control of this trimming technique for example.

In some embodiments this is used in combination with voltage trimming techniques to alter pulse width or voltage, to enable control of multiple factors (e.g. drop speed and drop weight). This can allow improved control of print appearance and quality. In some embodiments the internal resistance of a drive transistor such as the drain-source resistance of a single N-MOSFET is adjusted, which can reduce or avoid the need for a separate resistive component.

FIGS. 1 to 3, First Embodiment

FIG. 1 shows a schematic view of parts of a printhead according to an embodiment. An actuating element 110 is coupled in series with a drive circuit 100 and a variable resistance circuit 120. The actuating element is driven by a drive waveform created by the drive circuit. A return path is shown to complete the circuit. The actuating element and corresponding actuating chamber affected by the actuating element are configured so that the ejection of fluid has different sensitivities to changes in slew rates of different parts of the waveform. A control circuit 130 is provided to control the variable resistance so as to adjust the slew rate of the slope of lesser sensitivity. This enables the print characteristics of the actuating element to be compensated for distortions. The control can be made finer by adjusting the slew rate of whichever of the slopes is less sensitive, as discussed above, preferentially over any adjustment of the slew rate of the other of the slopes. Thus the control circuit need not be so precise, to achieve a given level of print quality. These benefits can arise even if the variable resistance is at the same side of the actuating element as the drive circuit, or even if the variable resistance is in parallel rather than in series, in principle, though in that case the dissipation is likely to be worse. The variable resistance can be implemented in various ways, including using a transistor element or a resistive element or an inductive element—in principle, anything that will alter the slew rate of the drive pulse.

FIG. 2 shows a time chart of waveforms at various points in the embodiment of FIG. 1 or of other embodiments, on the same time scale, to explain the effects of the drive operation for a relatively straightforward case for the sake of clarity. This is where the waveform is a pulse and the actuating element in the actuating chamber is arranged to provide a deflection suitable to cause fluid ingress on a leading edge of the drive pulse and fluid ejection on a trailing edge. Other more complicated waveforms are also conceivable and corresponding benefits can apply. A first waveform shows an example of a print signal, in this case a logic signal, where a pulse indicates a dot is to be printed and a lack of a pulse indicates no dot is to be printed. In some cases the signal can have multiple bits to indicate greyscales. In this example, there are two pulses shown. Below the print signal is shown an example waveform for a trim signal. In this case various levels are possible, so this can be an analog signal, or a multibit digital signal. As shown it starts at a low value at the time of the first pulse and has an increased value for the second pulse, and increases further for subsequent pulses.

Consequently the variable resistance (V R) control signal is shown in the next waveform down as having a low value for the first pulse and having a higher value for the leading edge of the second pulse, returning to the low value for the trailing edge of the second pulse. This leads to the resulting drive signal for the actuating element as shown in the bottom waveform in FIG. 2. There are two pulses shown, both down-going pulses. The first of the pulses has relatively steep leading and trailing edges. There is normally a slight slope corresponding to the capacitance of the actuating element. The second pulse has a shallower leading edge, at a timing corresponding to and caused by the higher value of the V R control signal. This higher value causes a higher value of resistance in series with the actuating element, which causes the leading edge to have a lower slew rate. This leading edge causes the volume of the actuating chamber to increase and the pressure to decrease and thus draw in fluid at a rate corresponding to the slew rate of the edge.

FIG. 3 shows a schematic cross section view of an example of an actuating chamber 111 to show this. The actuating chamber has an actuating element 110 in the form of a membrane forming a ceiling in the chamber. A nozzle 115 is provided in the form of an aperture in a floor of the chamber. The chamber has a connection for fluid ingress from a reservoir 113, one or more walls that can optionally be actuated and an exit port for recycling fluid back to the reservoir. In some cases the exit port is closed or no exit port is provided and the ingress port merely replenishes fluid that has been ejected. The ingress aperture may have a one way valve (not shown). In the example in FIG. 3, commonly referred to as a roof-actuated device, an actuator wall or membrane in the roof of the actuating chamber can be deformed up or down by a voltage applied by the drive circuit. After the leading edge of the drive pulse, the membrane is in the position shown by the upper dotted line, which shows the volume of the actuating chamber has increased. This causes the fluid to be drawn in. After the trailing edge of the drive pulse, the membrane is returned to the undeflected position. A lower dotted line shows an alternative position, for a different polarity of drive pulse for example. The volume of the nozzle chamber has been increased and then reduced, which causes fluid to be drawn in and then a droplet of fluid to be ejected. The resulting print of a dot has an appearance which depends particularly on the weight and velocity of the droplet, which depends on the slew rate of the slopes of the drive pulse as well as other factors such as height and width of the drive pulse, and fluid properties. The relationship between dot appearance and changes in slew rates has been found to be less sensitive for the edge which causes fluid draw in, which is the leading edge in this case, than for the edge which causes the ejection. Hence by adjusting the slew rate of the leading edge preferentially over any adjustment of the trailing edge, the control can be made less sensitive, and thus finer or more precise control can be achieved, or less precise circuitry can be used.

FIG. 4, Three Quarter View of Through-Flow Channel-Type Actuating Chamber

FIG. 4 shows a three quarter view of an arrangement similar to that of FIG. 3 having an actuating chamber 111 associated with the actuating element, the actuating chamber being in the form of a channel having a fluid ingress path for coupling with a reservoir for supply of the fluid and having a nozzle 115 for the ejection of the fluid from the actuating chamber. It shows a cut away view of just over half of the actuating element. The nozzle would be near the halfway point along the channel if the entire channel were shown. This is a side-wall actuated side-shooter design with through-flow, the ejection being stimulated by displacement of the actuating element causing pressure change in the fluid in the actuating chamber. As in FIG. 3, this is a through-flow type, and in this case the chamber is configured as an elongate channel. The actuating element is operable by a drive pulse, the channel acts as an actuating chamber containing the fluid, and is in communication with a supply of printing fluid for replenishment. The nozzle is shown in a floor of the chamber, formed by a nozzle plate 117.

The above-described trimming technique can be used in such a through-flow design, where the actuating chamber includes a fluid path for flowing through an amount of fluid, generally in a direction parallel with the nozzle plate, (though other arrangements are contemplated), and past an inner end of the nozzle. The fluid is in excess of that required to replenish the ejected drops from the printhead and may flow continuously past the inner end of the nozzle and along the channel to provide a continuous refresh of the ink over the nozzle, that can be used for ejecting through the nozzle. This through-flow technique is particularly desirable as it enables better temperature control and viscosity control of the ink, removal of sediment and air bubbles, and so on, thereby greatly improving printhead reliability.

Array of Actuating Chambers

From WO 2010055345 it is acknowledged that one arrangement of a printhead can have an array of fluid chambers separated by a plurality of piezoelectric walls. In many such constructions, the walls are actuable in response to electrical signals to move towards one of the two chambers that each wall bounds; such movement affects the fluid pressure in both of the chambers bounded by that wall, causing a pressure increase in one and a pressure decrease in the other. Nozzles in the form of apertures are provided in fluid communication with the chamber in order that a volume of fluid may be ejected therefrom. The fluid at the aperture will tend to form a meniscus owing to surface tension effects, but with a sufficient perturbation of the fluid this surface tension is overcome allowing a droplet or volume of fluid to be released from the chamber through the aperture; the application of excess positive pressure in the vicinity of the aperture thus causes the release of a body of fluid.

Some arrangements can have an array of elongate actuating chambers separated by actuating elements in the form of actuable walls, so as to maximise a resolution of printing. The chambers are formed as channels enclosed on one side by a cover member that contacts the actuable walls; a nozzle for fluid ejection is provided in this cover member. The cover member will often comprise a metal or ceramic cover plate, which provides structural support, and a thinner overlying nozzle plate, in which the nozzles are formed. The actuation of the walls of a chamber may cause the release of fluid from that chamber through its nozzle. In some examples, both the walls of a particular chamber are deformed inwards, this movement causing an increase in the fluid pressure within the actuating chamber and a decrease in pressure of the two neighbouring actuating chambers. The increase in pressure within that chamber contributes to the release of a droplet of fluid through the nozzle of that chamber.

In constructions where all chambers are provided with a nozzle, every chamber may be capable of fluid release. It will be apparent however, that since the actuation of a particular wall has a different effect on the pressure in its two adjacent actuating chambers, simultaneous release of fluid from both of the actuating chambers separated by a particular wall is difficult to achieve. There may be some asymmetry in the design of the apparatus to enable droplets released at different times to arrive on a substrate at the same time; for example, the nozzles may be located in different positions for different actuating chambers. During deposition the array will be moved relative to a substrate, thus two nozzles may be spaced in the direction of movement so that the spacing in position counteracts the difference in timing of droplet release. However, such constructional changes are permanent for an actuator and are thus able to compensate for only a specific pattern of droplet release timings; this leads to restriction of the methods used to drive the actuator walls.

Acoustic Waves

A further effect of the actuation of a wall shared by two chambers is that residual pressure disturbances remain in the chamber after the actuation has occurred. From the displacement within a fluid (acting as a proxy for the pressure within the fluid) in two neighbouring chambers following a single movement of the dividing wall, it is apparent that the pressure in each chamber oscillates about the equilibrium pressure (the pressure present in a chamber where no deformation of the walls takes place), with the amplitude of oscillation decaying to zero over a relaxation time (tR) for the system.

It is believed that the oscillation of pressure is caused by acoustic waves reflected at the surfaces, particularly the ends, of the actuating chamber. The period (TA) of these standing waves is known as the acoustic period for the chamber. In the case of a long, thin channel this period is approximately equal to L/c where L is the length of the channel and c is the speed of sound propagation along the chamber within the fluid. As mentioned above, residual pressure waves are present in both chambers either side of a wall following the movement of that wall. Therefore, when fluid is released from a particular chamber, pressure disturbances may be present in one or both of the neighbouring chambers, which may interfere with fluid release from the neighbouring chambers in a process known as 'cross-talk'. A timing of slopes in the drive waveform may be configured to take account of such cross talk, and may be timed to promote such acoustic waves by arranging for the deflections of the actuating element to be synchronised with the period and phase of such acoustic waves. For this purpose the drive waveform can therefore have one or more preliminary slopes or pulses to start an acoustic wave and form a standing wave, or maintain an existing standing wave, before a final pulse or slope to increase the wave and therefore the pressure, to exceed a threshold to cause a droplet to be ejected and form a printed pixel.

Figure 6:
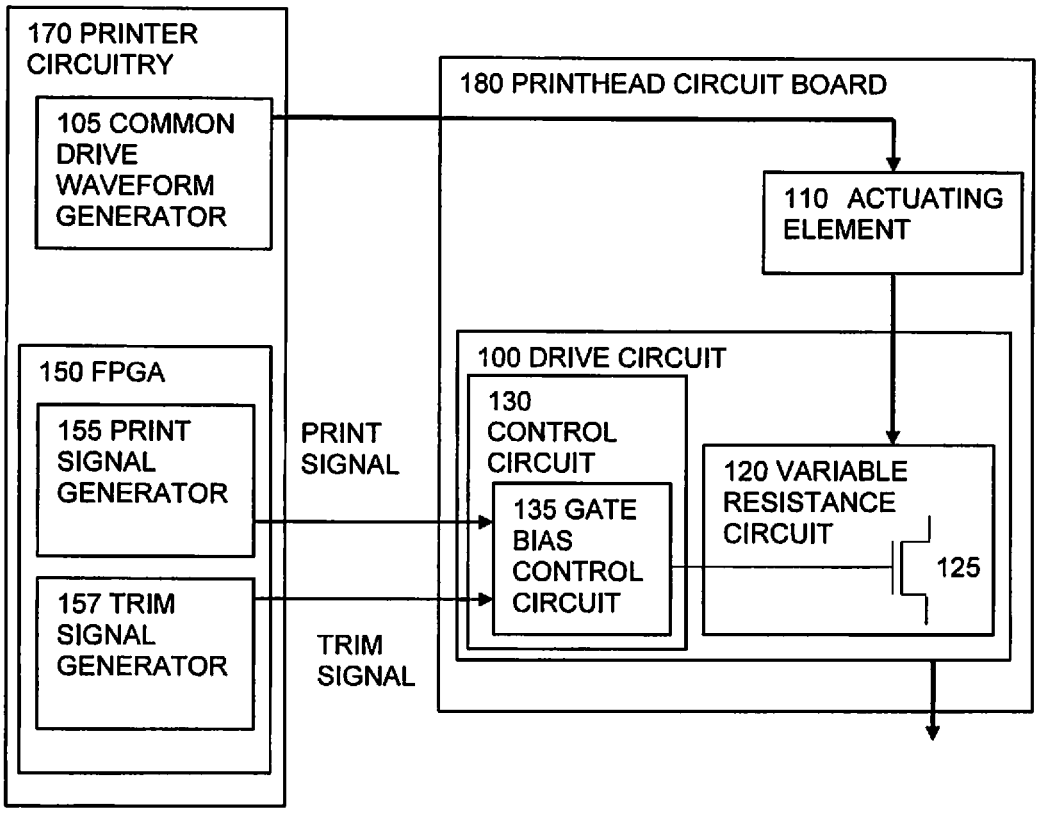
FIG. 6 shows a schematic view of another embodiment, showing further parts of a printer.

FIGS. 5, 6 Embodiment Using Drain-Source Resistance

FIG. 5 shows a schematic view of an embodiment in which the variable resistance circuit 120 is implemented by controlling the drain source resistance of a transistor 125 used for the drive pulses within the drive circuit 100. Some features correspond to those of FIG. 1 and similar reference numerals have been used as appropriate. This transistor could be a switching transistor for switching a common waveform, or could be an amplifying transistor for generating the drive waveform for example. In this case the control circuit 130 is implemented by a gate bias control circuit 135, which generates a gate bias according to the trim signal. The gate is also driven according to the print signal, to control the drive waveform such as the pulses as explained above in relation to FIG. 2. A common drive waveform generator 105 is shown, for the case that the transistor 125 is a switching transistor, for selectively switching the common drive waveform to each actuating element 110 according to the print signal. The drain source path of the transistor 125 is coupled in series with the common waveform generator and the actuating element. In principle the actuating element can optionally be located between the common drive waveform generator and the drive circuit 100.

FIG. 6 shows a schematic view of another embodiment, also showing further parts of a printer. Some features correspond to those of FIG. 5 and similar reference numerals have been used as appropriate. A printhead circuit board 180 has an actuating element 110 and a drive circuit 100. There can be many actuating elements, each with their own drive circuit. The drive circuit includes the transistor 125 configured as a switching transistor for switching a common drive waveform according to the print signal. As in FIG. 5, the gate of the transistor is coupled to the control circuit 130, implemented by a gate bias control circuit 135, which generates a gate bias according to the trim signal. Other circuitry is located off the printhead so as to reduce heat dissipation on the printhead which could affect print quality. The common waveform generator 105 and an FPGA 150 are such parts, shown as printer circuitry 170, coupled to the printhead circuit board. The FPGA is one way to implement a processor for implementing a print signal generator part 155 for processing an input such as a file of print data from a host, into print signals addressed to each actuating element and timed appropriately. The FPGA also has a trim signal generator 157 for generating the trim signal with appropriate timings, from an input such as a sensor for sensing temperature, or a store having actuating element characteristics based on an earlier calibration, or ageing information for example, depending on what characteristics are being compensated for.

For a MOSFET acting as a resistive element only the falling (leading) edge of the waveform is adjusted. This is due to the current direction being in the opposite direction during the rising edge, hence there is no need for the V R (variable resistance) control signal to distinguish between the leading and trailing edges. The use of the drain source resistance is compatible with both an industry standard pass-gate (where a common signal is fed to a set of pass-gates which control the supply of the waveform to each actuator) or with a novel and simpler arrangement using a single NMOS FET per actuator in an open drain arrangement with a common drive waveform coupled to the opposite side of the actuating element.

Figure 7:
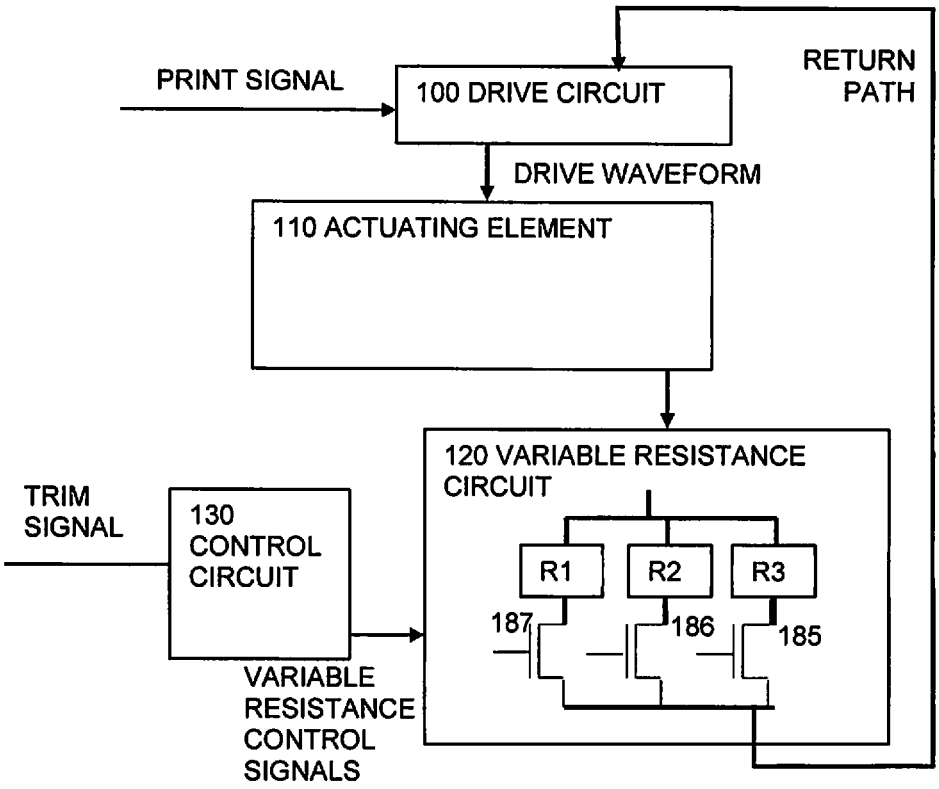
FIG. 7 shows a schematic view of another embodiment, using switched resistances.

FIG. 7, Embodiment Using Switched Resistances

FIG. 7 shows a schematic view of another embodiment, using switched resistances to implement the variable resistance circuit. Some features correspond to those of FIG. 1 and similar reference numerals have been used as appropriate. As in FIG. 1, an actuating element 110 is coupled in series with a drive circuit 100 and a variable resistance circuit 120. The actuating element is driven by a drive waveform created by the drive circuit. The variable resistance circuit has a bank of resistances R1, R2, R3, coupled in parallel. Each is switched in or out by switches 185, 186, 187, so that any number or combination of the resistances can be switched in as desired. Various implementations of this arrangement can be envisaged. A common drive waveform can be fed to one electrode of the actuating element 110. Connected to the other side of the actuating element can be the bank of switched resistances, which can have different values of resistance to maximise the possible different combinations. One of the switches (or a combination of switches) can be turned on to connect the actuating element to the return path, (for example ground) via the resistance. The effect of the resistance in series with the capacitive load of the actuating element is to slow the slew rate by a controllable amount. The control circuit 130 can output variable resistance control signals to control the transistors 185,186, 187, to select which resistances are switched in and to control the timing so that the slew rate of the leading edge is slowed, but not the slew rate of the trailing edge for example. Such a bank of switched resistors can be an alternative to, or can be combined with controlling the source drain resistance according to the trim signal as shown in FIGS. 5 and 6.

Figure 8:
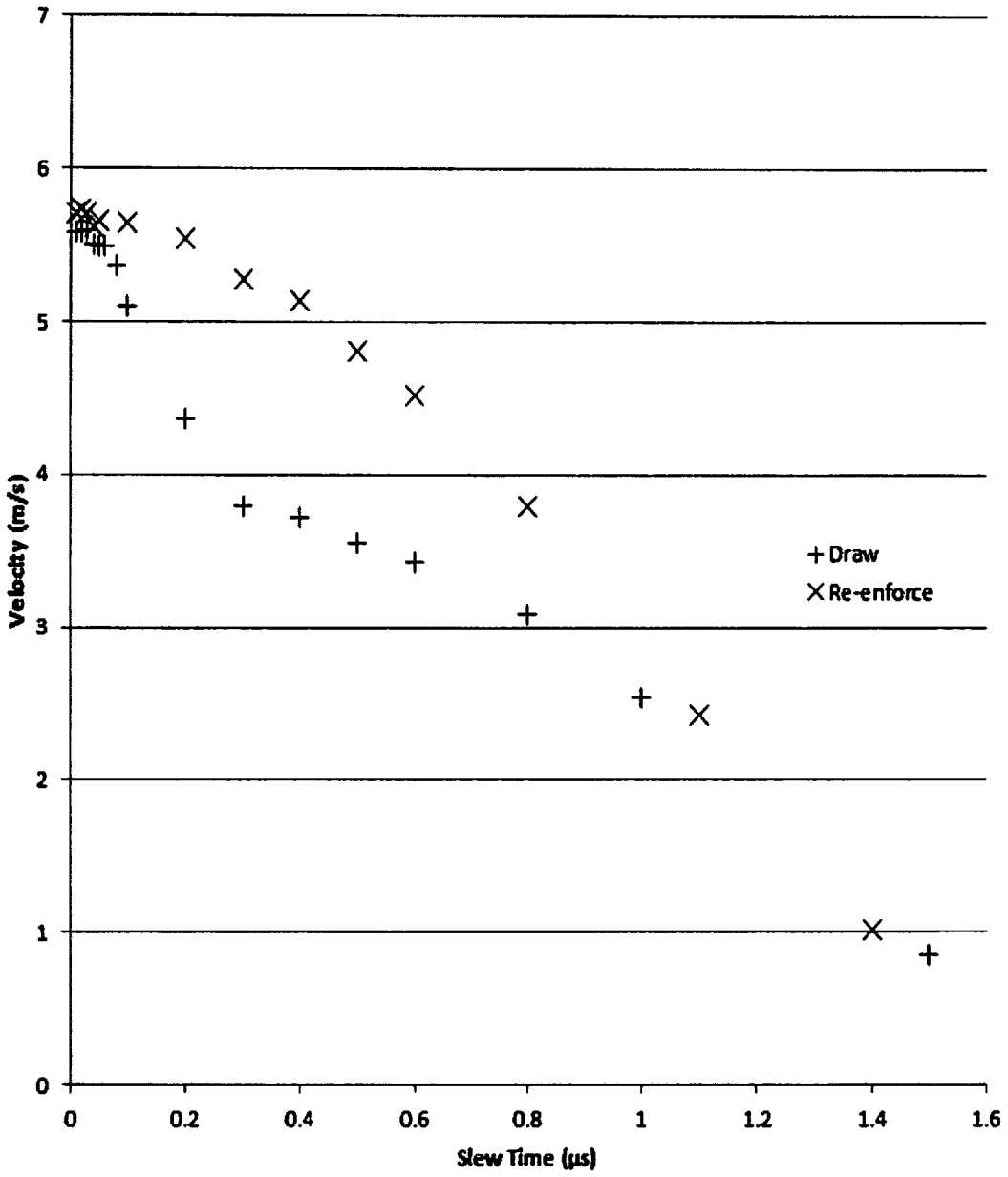
FIG. 8 shows a graph of droplet velocity for different slew times of the drive pulse.

FIG. 8, Graph of Droplet Velocity Versus Slew Time

FIG. 8 shows a graph of droplet velocity for different slew times of a drive pulse, showing effects of Slew-Rate on drop velocity. Points marked as "draw" points correspond to the leading edge of the pulse, used for drawing in fluid. Points marked as "re-inforce" show variation of the trailing edge slew time, where the pulse is ejected. As can be seen, the variation of velocity for the "draw" points is more gradual in some parts of the graph, particularly for slew times greater than 0.3 μs. A 0.2 μs variation in fall-time (draw) results in about 0.25 m/s droplet velocity change, whereas a similar variation in rise time ("re-enforce") results in a greater change in droplet velocity. A 0.2 μs change in fall time is achievable in one practical example with a 150 mV change in Vgs bias, for an example with a capacitance load of about 300 pF.

Acoustic Wave Effects

The first edge of a pulse can be used to rapidly increase the volume of the whole actuating chamber, which causes a large rarefaction in the fluid. The pressure in a manifold for supplying fluid into the chamber, is relatively unaffected by this initial actuation edge, being a much larger volume, and so pressure waves begin to propagate from the chamber ingress towards the nozzle. The whole actuation surface can be regarded as an infinite source of point sources, so some waves would first travel towards the manifold, get reflected and inverted, and then travel back towards the nozzle. The purpose of the second edge is to reinforce the natural superposition of the positive pressure waves arriving at the nozzle. Note that one option is to eject drops just by using a high amplitude draw pulse, so long as the overpressure through superposition of acoustic waves exceeds some threshold. Viscous dissipation can attenuate pressure to some level but for that first period of the acoustic wave this attenuation includes the very significant viscous damping action inside the nozzle, and acoustic energy 'loss' into the manifold; the mechanical damping of the structure etc. is relatively insignificant. Therefore a linear modelling of the acoustics (i.e. with no dissipation) is possible for designing the configuration of the chamber and the timing and shape of the drive waveform, and attenuation in the chamber can be disregarded for this analysis. In particular, the second, trailing edge, can be designed to reinforce, increasing the overpressure above that obtained by simple superposition of linear waves, and the slew rate will have a considerable effect on the resulting print as shown in FIG. 8. In contrast, the leading edge is tending to act before waves have had time to build and superimpose. This may contribute to the print output being less sensitive to adjustment of the leading edge, and so being more suitable in this case for trim adjustment by slew rate alteration.

Figure 9:
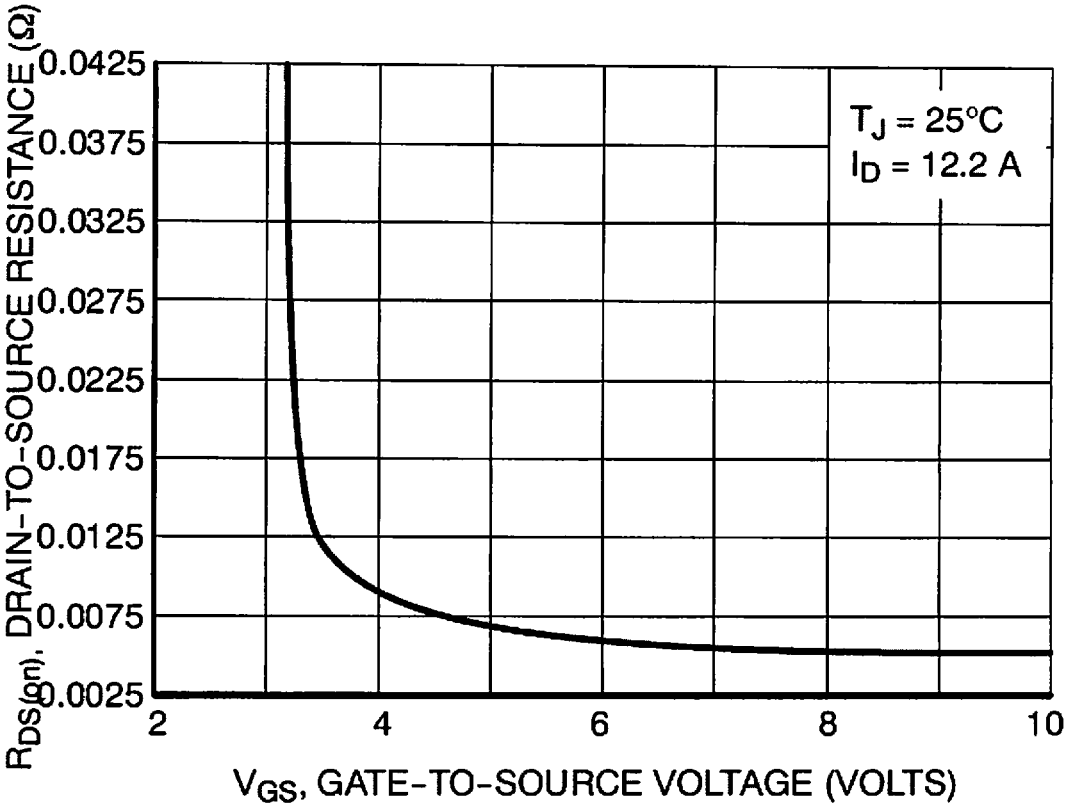
FIG. 9 shows a graph of resistance between the drain and source terminals.

FIG. 9, Graph of Drain Source Resistance

FIG. 9 shows a graph of resistance between the drain and source terminals for a typical MOSFET, showing how it varies with the voltage applied to the gate terminal, between about 0.006 ohms and about 0.0125 ohms for gate to source voltages of 5v to 3v respectively. This shows how the transistor used for switching of a common drive waveform, can also be used to vary the resistance and therefore adjust the slew rate of slopes of the drive waveform applied to the actuating element as described above. Examples of slew times of an example of a drive waveform having a pulse with a leading edge having a voltage change from about 38v down to 16v, are about 0.1 μs up to about 0.5 μs.

Figure 10:
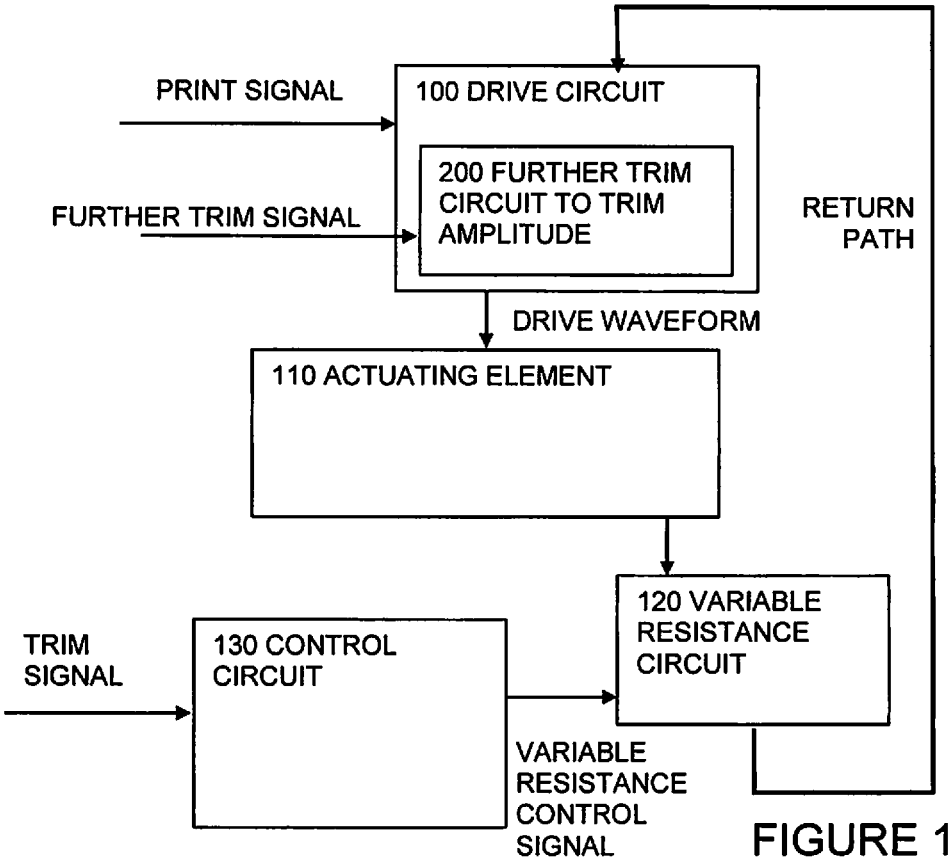
FIG. 10 shows a schematic view of another embodiment, having trim of drive pulse height.
Figure 11:
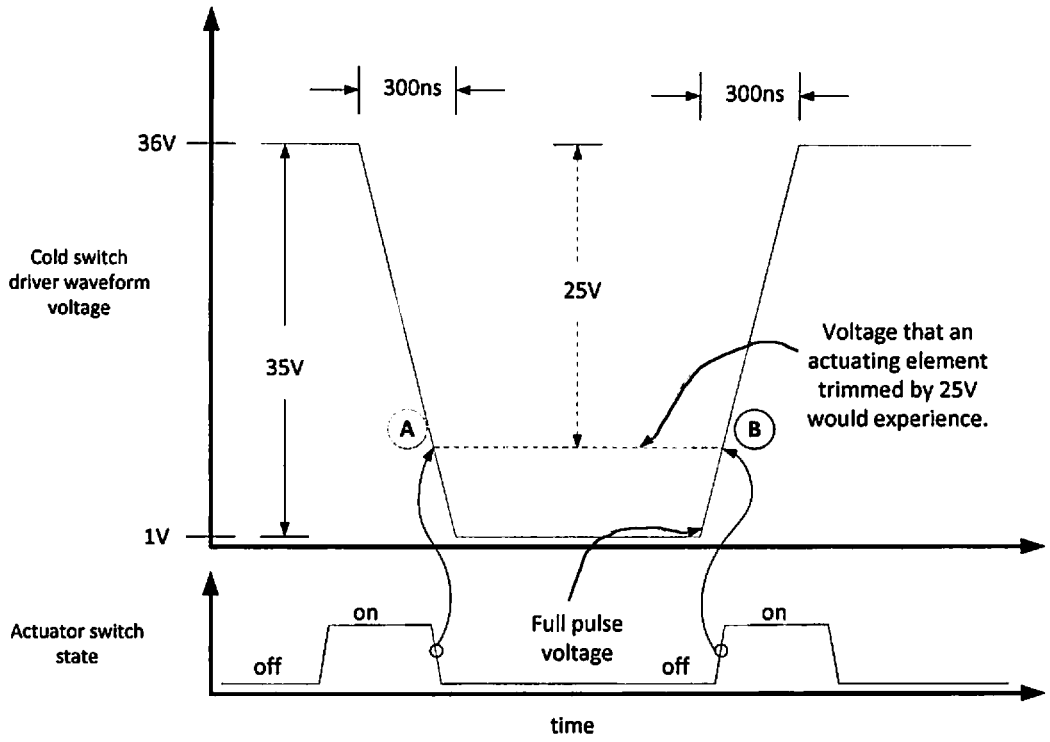
FIG. 11 shows a graph of a single pulse of the common drive waveform showing controlling the timing of switching to adjust pulse height.

FIGS. 10, 11, Embodiment with Further Trim of Waveform Amplitude

FIG. 10 shows a schematic view of another embodiment, also having trim of drive waveform amplitude. Some features correspond to those of FIG. 1 and similar reference numerals have been used as appropriate. As in FIG. 1, an actuating element 110 is coupled in series with a drive circuit 100 and a variable resistance circuit 120. In this case the drive circuit has a further trim circuit 200 to trim waveform amplitude according to a further trim signal. This can be implemented in various ways depending on the type of drive circuit. For a drive circuit having a cold switch arrangement, the timing of the switching can be adapted to cause a change in pulse height, as shown in the graph of FIG. 11.

FIG. 11 shows a single pulse of the common drive waveform showing the effect of controlling the timing of switching. This shows a cold switch driver (also referred to as common drive) waveform and shows a dotted line A-B showing the effect of trimming the voltage level by 25v rather than the untrimmed 35v. These voltages can be selected according to the type of actuating element. In this case the pulse slopes are 300 ns long though other values can be chosen. Below the waveform is shown a corresponding timing diagram of the switch state which corresponds to the control provided by the further trim signal. When the switch is on, the voltage across the actuating element will follow the common drive waveform. When the switch state is off, the voltage across the actuating element will remain roughly constant. Hence in the example shown, the actuating element state is on for most of the downgoing slope, until the waveform has changed by 25v, at point A. Then the switch is switched off, at a timing controlled according to the further trim signal. This means the voltage across the actuating element follows the dotted line, rather than following the solid line. At point B, the switch state changes to the on state. The voltage across the actuating element follows the upgoing slope of the common drive waveform. Note that although the trimming is made by altering the timing of the change of switch state, the trigger for deciding when to change state is made according to the further trim (and optionally other factors also). The further trim can be combined in various ways, for example it can be used as a coarse trim, with the slew rate based trim being for fine control, or they can be used separately for trimming different types of distortion for example.

Figure 12:
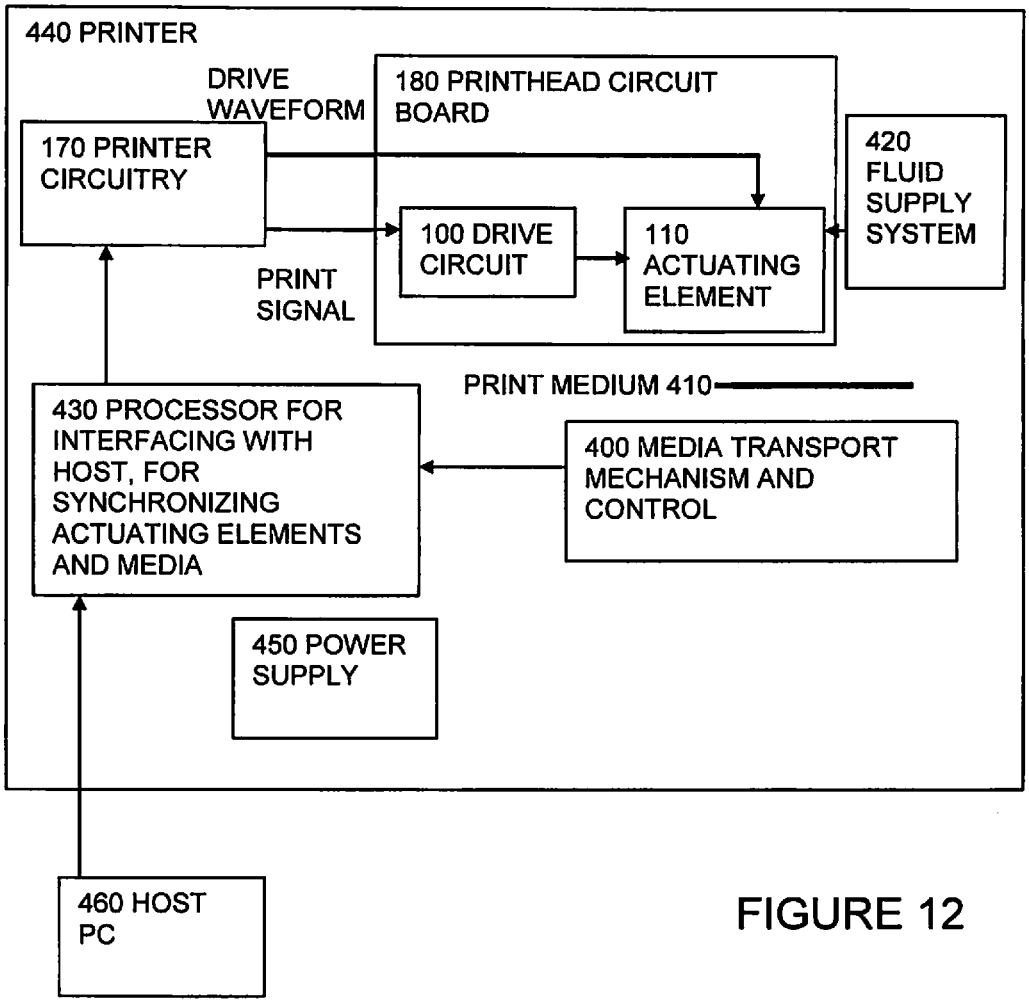
FIG. 12 shows a schematic view of a printer according to an embodiment, coupled to a host PC.

FIG. 12 Embodiment Showing Printer Features

The printhead arrangements described above can be used in various types of printer. Two notable types of printer are:

a) a page-wide printer (where printheads cover the entire width of the print medium, with the print medium (tiles, paper, fabric, or other example) rolling under the printheads), and b) a scanning printer (where a bundle of printheads slide back and forth on a printbar, whilst the print medium rolls forward in increments under the printheads, and being stationary whilst the printhead scans across). There can be large numbers of printheads moving back and forth in this type of arrangement, for example 16 or 32, or other numbers.

In both scenarios, the printheads can optionally be operating several different colours, plus perhaps primers and fixatives or other special treatments. Other types of printer can include 3D printers for printing fluids such as plastics or other materials in successive layers to create solid objects.

FIG. 12 shows a schematic view of a printer 440 coupled to a source of data for printing, such as a host PC 460 (which can be external or internal to the printer). Some features correspond to those of FIG. 6 and similar reference numerals have been used as appropriate. As in FIG. 6, there is a printhead circuit board 180 having an actuating element 110 and a drive circuit 100, for example in the form of an ASIC. As described above, the drive circuit can selectively apply a drive waveform having several slopes, to an actuating element, according to a print signal. A resulting print has a lesser sensitivity to changes of slew rate in one slope of the drive waveform than a sensitivity to change in another. Printer circuitry 170, is coupled to the printhead circuit board, and coupled to a processor 430 for interfacing with the host, and for synchronizing actuating elements and the print media. This processor is coupled to receive data from the host, and is coupled to the printhead circuit board to provide synchronizing signals at least. The printer also has a fluid supply system 420 coupled to the actuating elements, and a media transport mechanism and control part 400, for locating the print medium 410 relative to the nozzles. This can include any mechanism for moving the actuating elements, such as a movable printbar. Again this part can be coupled to the processor to pass synchronizing signals and for example position sensing information. A power supply is also shown, for supplying power to the various parts of the printer (supply connections are omitted from the figure for the sake of clarity).

The printer can have a number (for example seven) of inkjet printheads attached to a rigid frame, commonly known as a print bar. The media transport mechanism can move the print medium beneath or adjacent the print bar. A variety of print media may be suitable for use with the apparatus, such as paper sheets, boxes and other packaging, or ceramic tiles. Further, the print media need not be provided as discrete articles, but may be provided as a continuous web that may be divided into separate articles following the printing process.

The printheads may each provide a linear array of actuating chambers having respective nozzles for ink droplet ejection, with the nozzles in each linear array evenly spaced. The printheads can be positioned such that the nozzle arrays are parallel to the width of the substrate and also such that the nozzle arrays overlap in the direction perpendicular to the relative motion of the substrate. Further, the nozzle arrays may overlap such that the printheads together provide an array of nozzles that are evenly spaced in the direction perpendicular to the motion (though groups within this array, corresponding to the individual printheads, can be offset in the direction of the motion). This may allow the entire width of the substrate to be addressed by the printheads in a single printing pass.

The printer can have circuitry for processing and supplying image data to the printheads. The input from a host PC for example may be a complete image made up of an array of pixels, with each pixel having a tone value selected from a number of tone levels, for example from 0 to 255. In the case of a colour image there may be a number of tone values associated with each pixel: one for each colour. In the case of CMYK printing there will therefore be four values associated with each pixel, with tone levels 0 to 255 being available for each of the colours.

Typically, the printheads will not be able to reproduce the same number of tone values for each printed pixel as for the image data pixels. For example, even fairly advanced greyscale printers (which term refers to printers able to print dots of variable size, rather than implying an inability to print colour images) will only be capable of producing 8 tone levels per printed pixel. The printer may therefore convert the image data for the original image to a format suitable for printing, for example using a half-toning or screening algorithm. As part of the same or a separate process, it may also divide the image data into individual portions corresponding to the portions to be printed by the respective printheads. These packets of print data may then be sent to the printheads.

The fluid supply system can provide fluid such as ink to each of the printheads, for example by means of conduits attached to the rear of each printhead. In some cases, two conduits may be attached to each printhead so that in use a flow of ink through the printhead may be set up, with one conduit supplying ink to the printhead and the other conduit drawing ink away from the printhead.

In addition to being operable to advance the print articles beneath the print bar, the media transport mechanism may include a product detection sensor (not shown), which ascertains whether the medium is present and, if so, may determine its location. The sensor may utilise any suitable detection technology, such as magnetic, infra-red, or optical detection in order to ascertain the presence and location of the substrate.

The media transport mechanism may further include an encoder (also not shown), such as a rotary or shaft encoder, which senses the movement of the media transport mechanism, and thus the substrate itself. The encoder may operate by producing a pulse signal indicating the movement of the substrate by each millimetre. The Product Detect and Encoder signals generated by these sensors may therefore indicate to the printheads the start of the substrate and the relative motion between the printheads and the substrate. The processor can be used for overall control of the printer systems. This may therefore co-ordinate the actions of each subsystem within the printer so as to ensure its proper functioning. It may, for example signal the ink supply system to enter a start-up mode in order to prepare for the initiation of a printing operation and once it has received a signal from the ink supply system that the start-up process has been completed it may signal the other systems within the printer, such as the data transfer system and the substrate transport system, to carry out tasks so as to begin the printing operation.

Other embodiments and variations can be envisaged within the scope of the claims.

The invention claim is:

1. A printhead having:

actuating elements for ejecting fluid droplets, a drive circuit for receiving a common drive waveform, the drive circuit comprising a drive switch for selectively switching the common drive waveform onto the actuating element, to selectively apply the received common drive waveform to at least one of the actuating elements according to a print signal to cause the fluid droplets to be ejected, with resulting droplet ejection properties being dependent on at least a slew rate of a trailing edge of the common drive waveform and a slew rate of a leading edge of the common drive waveform, and having a variable resistance circuit to adjust slew rates of the common drive waveform, and a control circuit configured to control the variable resistance circuit according to a trim signal to adjust the slew rate of the leading edge of the common drive waveform, the droplet ejection properties being less sensitive to adjustment of the slew rate of the leading edge than to adjustment of the slew rate of the trailing edge.

2. The printhead of claim 1, the variable resistance circuit comprising a drain source path of a transistor and the control circuit comprising a gate bias control circuit coupled to a gate of the transistor to control a drain source resistance of the transistor according to the trim signal.

3. The printhead of claim 1, the variable resistance circuit having a bank of resistors (R1, R2, R3) and corresponding resistor switches for selectively coupling the resistors into use.

4. The printhead of claim 1, the variable resistance circuit being coupled in series with the drive switch and the actuating element.

5. The printhead of claim 2, the transistor of the variable resistance circuit being configured as the drive switch for the drive circuit.

6. The printhead of claim 1, having an actuating chamber associated with the actuating element, the actuating chamber having a fluid ingress path for coupling with a reservoir for supply of the fluid and having a nozzle for the ejection of the fluid from the actuating chamber, such that the ejection can be stimulated by displacement of the actuating element causing pressure change in the fluid in the actuating chamber.

7. The printhead of claim 6, the actuating chamber and a timing of the slopes of the common drive waveform being configured to promote an acoustic wave in the fluid in the actuating chamber to cause the ejection.

8. The printhead of claim 1, and having a further trim circuit configured to adjust an amplitude of the common drive waveform according to a further trim signal.

9. A printer having a printhead according to claim 1.

10. A drive circuit suitable for the printhead of claim 2 and having:

a variable resistance circuit, and a control circuit configured to control the variable resistance circuit according to a trim signal to adjust a slew rate of the leading edge of the common drive waveform, the droplet ejection properties being less sensitive to adjustment of the slew rate of the leading edge than to adjustment of the slew rate of the trailing edge.

11. The printhead of claim 3, the variable resistance circuit comprising a drain source path of a transistor and the control circuit comprising a gate bias control circuit coupled to a gate of the transistor to control a drain source resistance of the transistor according to the trim signal, and the transistor of the variable resistance circuit being configured as the drive switch for the drive circuit.

12. A method of operating a printer having actuating elements for ejecting fluid droplets, the method having steps of:

receiving a common drive waveform, switching the common drive waveform onto the actuating elements, selectively applying the received common drive waveform to at least one of the actuating elements, according to a print signal to cause the fluid droplets to be ejected, with a resulting droplet ejection properties being dependent on at least a slew rate of a trailing edge of the drive waveform and a slew rate of a leading edge of the drive waveform, generating a trim signal for adjusting the common drive waveform to compensate for unwanted distortions, and adjusting, using the generated trim signal, the slew rate of the leading edge of the drive waveform, the droplet ejection properties being less sensitive to adjustment of the slew rate of the leading edge than to adjustment of the slew rate of the trailing edge.

13. A printhead having:

actuating elements for ejecting fluid droplets, a drive circuit for selectively applying a common drive waveform to at least one of the actuating elements according to a print signal to cause the fluid droplets to be ejected, with resulting droplet ejection properties being dependent on at least a droplet-ejecting edge of the common drive waveform and a non-droplet-ejecting edge of the common drive waveform, wherein the non-droplet-ejecting edge enables fine control of the droplet ejection properties, the drive circuit having:

a variable resistance circuit, and a drive switch for selectively switching the common drive waveform onto the actuating element, and a control circuit configured to control the variable resistance circuit according to a trim signal to adjust the non-droplet-ejecting edge preferentially over adjustment to the droplet-ejecting edge.

* * * * *